US007008351B2

(12) United States Patent
Parker

(10) Patent No.: US 7,008,351 B2
(45) Date of Patent: Mar. 7, 2006

(54) TRAINING DEVICE

(76) Inventor: Ernest R. Parker, 11550 E. Jerry St., Cerritos, CA (US) 90703

( * ) Notice: Subject to any disclaimer, the term of this patent is extended or adjusted under 35 U.S.C. 154(b) by 556 days.

(21) Appl. No.: 10/154,301

(22) Filed: May 23, 2002

(65) Prior Publication Data

US 2003/0220173 A1 Nov. 27, 2003

(51) Int. Cl.
*A63B 69/00* (2006.01)

(52) U.S. Cl. ..... 482/44; 482/20; 482/148; 473/422; 446/421

(58) Field of Classification Search ..... 482/44–46, 482/20, 49, 50, 92, 109, 110, 148; 473/219, 473/422, 451, 459; 446/129, 132, 265, 397, 446/418, 419, 421, 422; 434/247, 249; 273/456
See application file for complete search history.

(56) References Cited

U.S. PATENT DOCUMENTS 1,658,108 A * 2/1928 Vaughn ..... 482/109
2,592,013 A * 4/1952 Curley ..... 473/333
3,113,781 A * 12/1963 Guier ..... 473/234
3,113,782 A * 12/1963 Guier ..... 473/234
3,137,504 A * 6/1964 Zordan et al. ..... 473/457
3,254,895 A * 6/1966 Haas ..... 473/234
3,498,616 A * 3/1970 Hurst ..... 473/234
4,027,886 A * 6/1977 Katsube ..... 473/234
4,325,549 A * 4/1982 Vasselli ..... 473/519
4,480,828 A * 11/1984 Kifferstein ..... 482/74
4,794,905 A * 1/1989 Woolard ..... 124/5
5,092,588 A * 3/1992 DeLuca ..... 482/44
5,372,558 A * 12/1994 Perry et al. ..... 482/49
5,441,255 A * 8/1995 Verbick ..... 473/55
5,830,091 A * 11/1998 Romanick ..... 473/596
6,024,660 A * 2/2000 Romanick ..... 473/596
6,152,858 A * 11/2000 Kolb ..... 482/44

* cited by examiner

*Primary Examiner*—Jerome W. Donnelly
*Assistant Examiner*—Victor K. Hwang
(74) *Attorney, Agent, or Firm*—Maria Erlinda Co Sarno

(57) ABSTRACT

A training device for acquiring the correct hand motion associated with the different types of sport and for strengthening the wrist and forearm. The device is simple and portable. It utilizes a combination of a magnet and a plunger, the magnet having a sufficient force to keep the plunger attached but not strong enough to prevent the plunger from dislodging from the magnet when a user snaps the device. The device is designed so that the snapping sound caused by the plunger hitting a wall synchronizes with the impact on the muscles felt by the user during a hand motion.

20 Claims, 3 Drawing Sheets

TRAINING DEVICE

BACKGROUND

This invention strengthens the muscle of the forearm and the wrist as well as develops motor memory on particular hand motions. This device is a good training aid for activities that uses the forearm and the wrist such as in throwing the ball and for motions associated with the sports of softball, baseball, tennis, racquetball and the like.

A throwing device currently in the market is a ball, the size of a soft ball, with a screwed in protruding tubular cylinder housing a plastic covered shaft with a cylindrical metal rod having a bore at the center enabling the metal rod to travel along the shaft. In the present device, the size of the ball does not allow the user to fully and firmly grip on the ball during a desired hand motion. The longitudinal walls of the tubular cylinder is made of clear plastic to allow the user to see and position the metal rod inside the cylinder. The device does not allow the user to perform consecutive throws, one after the other, because it requires repositioning of the metal rod along the shaft after every throw, usually done by the user himself through positioning of the hand aided, if needed, by slight shaking. Because nothing keeps the metal rod from moving to and from one end to the other of the shaft, the metal rod can move away from a desired position even with a slight change of angle in the holding of the device. In a throwing position such as an underarm or overarm throw, the metal rod slides along the shaft with the movement of the arm and hand, consequently, the metal rod may not be in the desired position when the user performs a snapping motion. Likewise, the snapping sound heard when the metal rod hits the distal end of the protruding cylinder may not coincide with the wrist snap. Snapping motion is the fast motion that imparts or dislodges a ball from the hand of a user or player. Herein, proximal means near the user while distal means away from the user and opposite the proximal end. Wrist snap is an impact felt on the muscle at the completion of a throwing motion It is therefore an object of this invention to provide a training device that would give a snapping sound coincidence to a proper snapping motion of a user.

It is also an object of this invention to provide a training device that can be used to do consecutive, one after the other, throwing, hitting or swinging motions.

It is also an object of this invention to provide a training device that will aid in developing motor memory for a particular hand motion.

It is also a further object of this invention to provide a training device that can strengthen the muscles of the forearm and the wrist.

SUMMARY OF THE INVENTION

This invention relates to a training device comprising a handle; a barrel extending perpendicularly from the handle; a magnet vertically positioned at a proximal end of the barrel; a plunger attracted to the magnet , the plunger producing a snapping sound when the plunger hits a wall on a distal end of the barrel when dislodged from the magnet; means for interconnecting the handle with the barrel; and, means for holding the magnet stationary. The training device may have a casing to envelope the barrel to keep this and the magnet and plunger in place. The casing may also be used to adjust the outer surface to a desired diameter, usually matching that of the handle. A reinforcement, usually made of a nonmagnetic metal, may be used to protect the surfaces of the handle, magnet, casing or barrel from damage due to the repeated impact or beating of the plunger at the respective surfaces mentioned above. The magnet used has sufficient force to keep the plunger attached to it but this same force should not prevent the plunger from disengaging or dislodging from the magnet when a user snaps the plunger away from the magnet with a desired hand motion.

A method of using an enclosed training device having a magnet and a plunger releasable from the magnet by a snapping hand motion, comprising: assuming a position as one would take for a particular motion; holding the training device; doing a correct hand motion for the particular motion; and, snapping the device thereby releasing the plunger from the magnet. The device is usually held with the barrel between the index and the middle finger and the hand motion may or may not be accompanied by a proper foot motion, depending upon the type of motion that the user is training for.

DETAILED DESCRIPTION OF THE INVENTION

Figure 1:
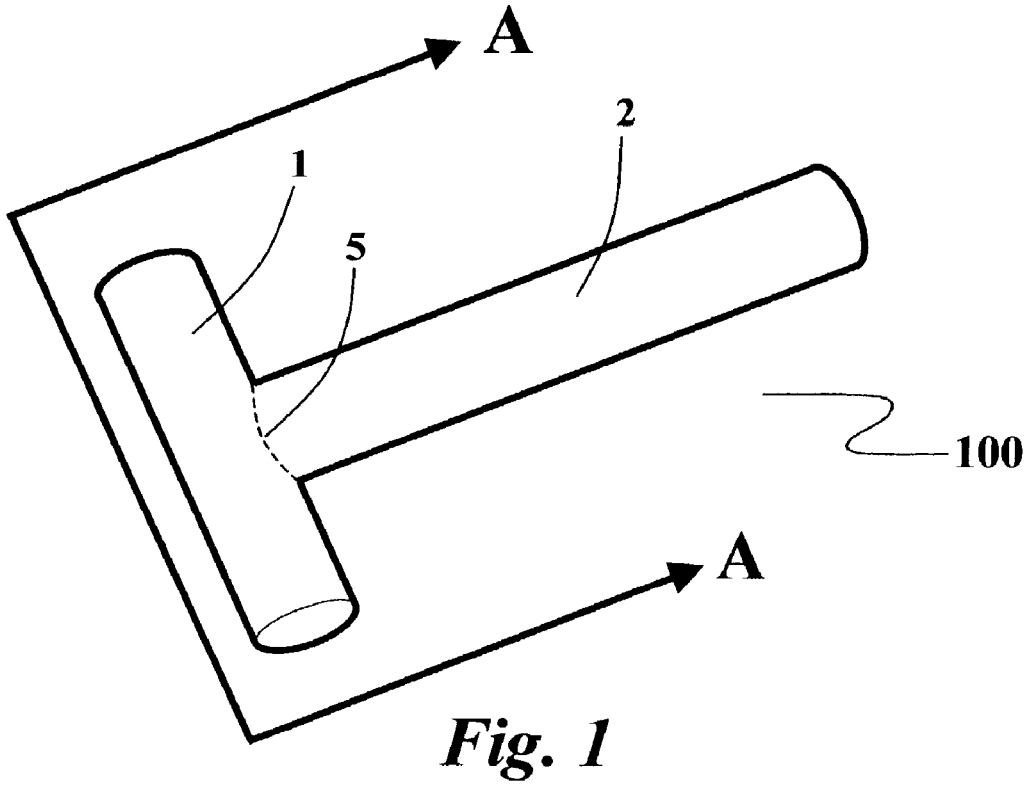
FIG. 1 shows a perspective view of the training device.
Figure 1A:
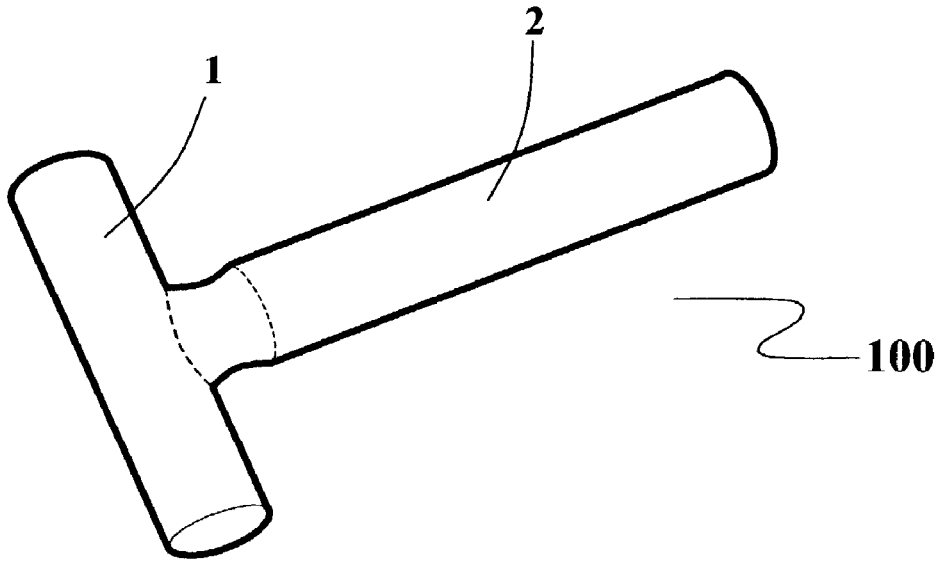
FIG. 1A shows a perspective view of the training device with sloping indentations at the junction of the handle and the body to comfortably accommodate the hand and fingers.
Figure 2:
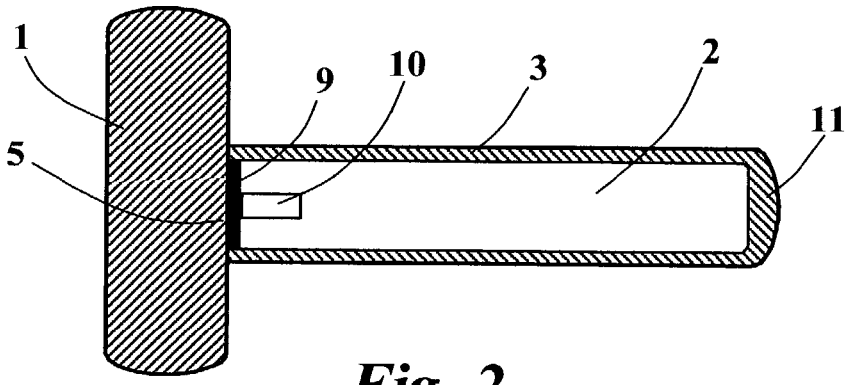
FIGS. 2, 2A, 2B and 2C shows cross sectional views on the different ways of assembling the components of the training device taken along A—A.
Figure 2A:
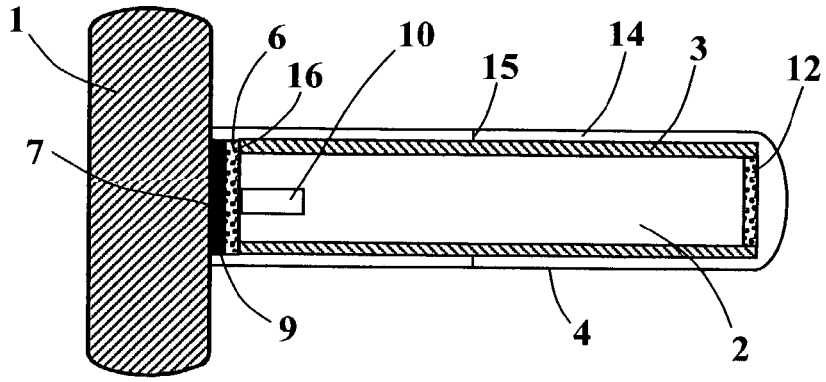
Figure 2B:
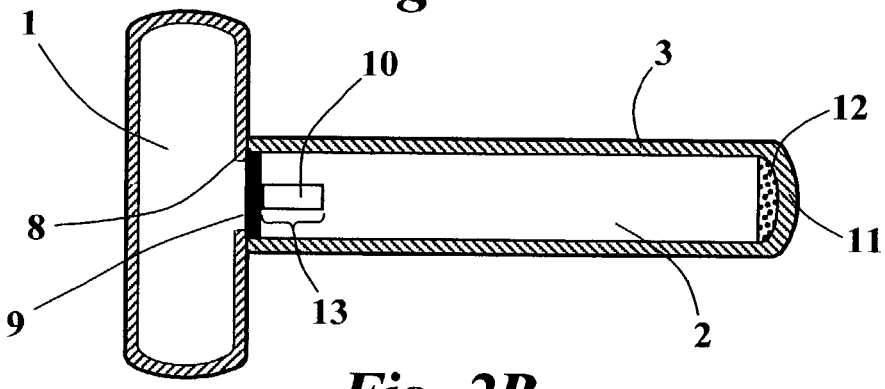
Figure 2C:
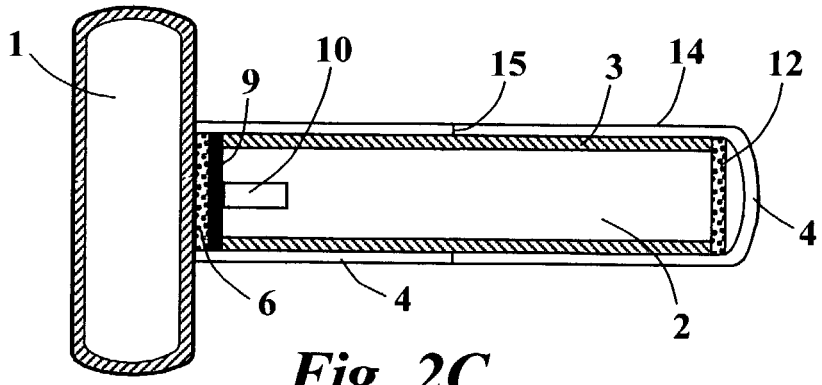
Figure 3:
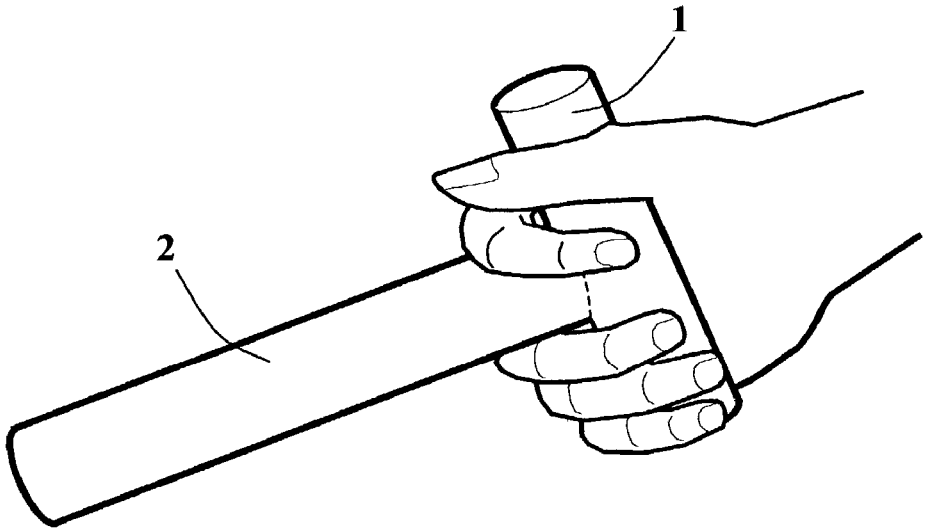
FIG. 3 is a perspective view of how a user grips on the training device.

The training device 100 for developing a correct execution of a hand motion is shaped like a tubular T as shown in FIG. 1. The head 1 and body 2 of the T, the head positioned perpendicularly from the body, may be shaped to ergonometrically accommodate the hands of a user. One way for example is shown in FIG. 1A. The head is vertically oriented while the body 2, comprising of a barrel 3 with or without a casing 4, is horizontally oriented. FIGS. 2, 2A, 2B and 2C show cross sectional views of the device which detail the different ways of assembling the components. The different features can be mixed and matched, meaning, the set up at the proximal end of FIG. 2A can be the set up at the proximal end of FIG. 2B, etc. The casing 4, head 1 and barrel 3 of the device can be made out of plastic, wood, non-magnetic metal or combinations of these. The vertical head 1 of the device, hereinafter referred to as handle 1 is preferably cylindrical in shape having a diameter that can be easily gripped by the hand of the user. The diameter is preferably tailored to the age and sex of the user but it can also be made to fit any size. FIG. 3 shows how the device is normally held by the user. The horizontal body 2 or the barrel 3 which is also preferably cylindrical in shape, is usually positioned between the index finger and the middle finger during usage. The handle 1 may have a hollow or solid interior. FIGS. 2 and 2A have solid interiors while FIGS. 2B and 2C have hollow interiors. The junction 5 where the handle 1 and the body 2 meets, must be solid. If the solid handle is made of plastic or wood, a reinforcement 6 such as a metal plate will prevent eventual indentation on the face 7 of the handle, the side facing towards the horizontal body 2 or barrel 3 as shown in FIG. 2C. If a metal plate is used, a thickness of at least 1 mm is sufficient. The metal should be rigid, non-flexible and nonmalleable. If the handle 1 is hollow, and has an open face 7, the junction should be designed with a protruding lip 8 where a magnet 9 or a reinforcement 6 may be placed or attached to as shown in FIG. 2B or the hollow handle can be closed at the junction 5 facing the barrel 3 with a solid material as shown in FIG. 2C to prevent the other components of the device from entering the hollow interior of the handle. The reinforcement 6 or closed surface is optional but must be stationary if incorporated. The reinforcement 6 need not be placed adjacent to face 7 as shown in FIG. 2A. The magnet 9 may be placed adjacent to face 7 instead of the reinforcement 6 as shown in FIGS. 2, 2A and 2B. The reinforcement 6 may be placed adjacent to the magnet at the lateral side opposite that facing face 7 thereby positioning itself between the magnet and the plunger as shown in FIG. 2C. The magnet is disk shaped and positioned vertically. The methods for attaching the reinforcement 6 and/or magnet 9 or providing a closed wall at the junction 5 between the handle and the body can be done by several means known in the art. The reinforcement and/or the magnet may not be attached to the handle or to each other but may just be inserted and kept in place by the barrel 3 when enclosed by the casing 4 as shown in FIGS. 2A and 2C.

As shown in FIGS. 2, 2A, 2B and 2C, the barrel 3 is hollow and houses the components of the training device. The magnet 9 should have sufficient force to keep a plunger 10 attached to the magnet either directly or with a reinforcement in between the plunger 10 and the magnet 9 before a snapping motion, but not strong enough to prevent the plunger 10 from disengaging or dislodging from the magnet 9 when a user grips the handle 1 and performs a snapping motion such as a throwing motion. The magnet and the plunger are the core components that differentiates this device from the others. The magnet should be kept stationary and if a reinforcement is placed between the magnet and the plunger, the reinforcement should be of a dimension and material make up that would not impede the attraction between the magnet 9 and the plunger 10. The plunger 10, placed after the magnet 9 or the reinforcement 6, is not a magnet but is made of a magnetic material to allow it to attach to the magnet 9. The end 11 of the barrel 3 is either closed as shown in FIGS. 2 and 2B or open as shown in FIGS. 2A and 2C. Like the face 7 of the junction 5, the wall on this end 11 must be thick enough to withstand the repeated beating of the plunger 10 every time a user performs a snapping motion such as a throwing or thrusting motion as shown in FIG. 2. The end 11 may also be reinforced with the same metallic materials and methods used for reinforcing magnet 9 or face 7 of the handle. FIGS. 2A, 2B and 2C show the end 11 with the different ways of incorporating a reinforcement 12. The plunger 10 is preferably shaped like a cylindrical rod having a diameter smaller than the inside diameter of the barrel 3 to allow free motion of the plunger 10 from one end of the body to the other once it has been dislodged from the magnet 9. Any other shape can also be used so long as it does not have an outside surface that can snag or hit the inside surface of the barrel thereby impeding the free motion of the plunger 10 along the inside of barrel 3. The length 13 of the plunger 10 is a little bit longer, consequently heavier, for the youth compared to that used by adults to allow easier dislodgment from the magnet due to its increased weight, assuming that the magnets are of similar size, dimensions and shape. The same principle should be used for plungers that are not cylindrical in shape.

The components, magnet, reinforcement and plunger, of the training device may be introduced inside the barrel during the molding or the construction of the device or it may be introduced later after the individual parts, handle, barrel and casing, have been made. The handle and the barrel may be molded as a single piece if a plastic or nonmagnetic metal material is used. If the handle and barrel are molded as a single piece, there may not be a need for a casing as shown in FIGS. 2 and 2B. A casing 4 surrounds or envelopes the barrel 3 to keep the parts and components in place and/or to keep the diameter of the outside surface of the device uniform. If assembled with a casing, the casing 4 usually extends from the handle 1 to have a good overlap over one end of the barrel 3, preferably to around the midpoint of the barrel 3 and a capsule like cap 14 fits over the other end of the barrel 2 as shown in FIGS. 2A and 2C. The end of the casing extending from the handle 1 is shown to meet the open end of the capsule like cap 14 at 15 as shown in FIGS. 2A and 2C. It is recommended to glue the two meeting ends of the casing together at 15. For all types of materials, the parts can be individually manufactured, assembled and interconnected. Methods of interconnecting the parts are known such as screwing, snap fitting, friction fitting and gluing one part to the other. It is very important that the parts do not come apart after the training device has been assembled for use. There are many ways of designing the training device. Any design having an enclosed housing with a metal attached to a magnet that is releasable by a snapping motion or a fast shake is within this invention.

The device can come in different dimensions. A typical device illustrated herein as an example, has a handle 1 having a vertical length of 3 to 3½ inches, a diameter of 1 to 1⅛ inches, and a body 2 or barrel 3 having an outside diameter similar to the handle. The barrel 3 has an inside diameter of approximately ⅝ inches or more. The thickness 16 of the solid wall between the outside diameter and the inside diameter of the barrel 3 may be used to press the magnet 9 and/or reinforcement 6 against the face 7 of the handle or against a protruding lip 8 of the handle as shown by FIGS. 2A and 2C to keep the components in place. This may also be used to press the reinforcement 12 against the distal end of the casing as shown in FIG. 2C. The length of the device is kept at approximately 7 inches from tip to tip, measured from the outside lateral side of the handle to the distal end of the barrel, to coincide the snapping sound as the plunger 10 hits the closed distal end 11 of the barrel 3 or reinforcement 12 at the distal end of the barrel with the impact felt on the muscles of the user's wrist and forearm during the snapping motion. This synchronization of sound helps the user in arriving at the correct way of executing the proper snapping motion required for each type of hand motion thereby providing both an audio and visual feedback. The length of the barrel in the above illustration may be derived by simple subtraction. For others, this can be easily derived by proportionately expanding or reducing the dimensions of the example given above.

This training device is portable and can be used anywhere and anytime especially during one's free time, for example, while watching television, thereby making excellent use of the time. The device can be used for any type of motions involving the wrist, hand and/or arm as in throwing a fast ball, rise ball, drop ball, curve, screw, change up, and the like. The device is generally used as follows: A user or player assumes the same position as he/she would for a particular motion such as throwing a fastball, etc. except that the user will be holding the training device 100 instead of a ball; does or performs the correct motion of the hand and of the feet, the latter if required, for the particular motion; and, snaps the device in the same manner as one would impart or dislodge a ball from one's hand. If the motion does not involve a ball such as a racquet, the same is true. Instead of the racquet, one holds the training device and executes the same motion. In all of the hand motions above, unlike the ball, the training device remains at the hand of the user. The final snapping motion, simulating the release of the ball or the swinging hand motion as the case maybe, instead of actually releasing the device from one's hand, the release is synchronized with the snapping sound produced when the plunger 10 hits the closed distal end 11 of the barrel 3 or the reinforcement 12. By doing this repeatedly, a user develops the routine of correctly executing a hand motion, and associates the snapping sound coincidentally with the mental picture of throwing the ball or hitting/swinging at a ball as the case may be.

Figure 4:
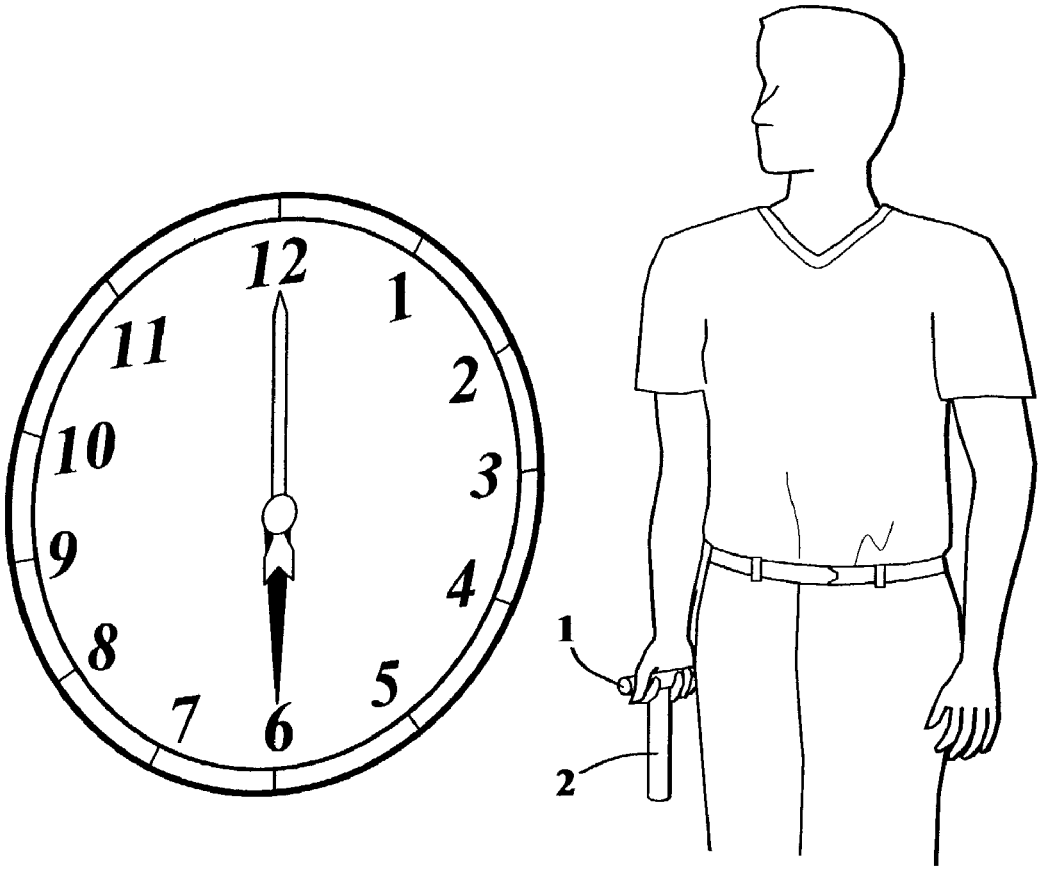
FIG. 4 shows the position of the user relative to a clock to provide proper orientation on the illustrations of the different hand motions.

To further clarify the process, a few types of motion associated with the sport of softball, are described below. For example, if one is training for a fastball, a user grips the device on the handle and positions the barrel between the index and the middle finger of the hand that will perform the snapping motion. While the illustrations here are adopted for a right hand motion, it applies equally well for a left hand motion. His body or the pertinent parts thereof then assumes the same position as he/she would do in making the actual motion. For the fastball, he/she puts his/her right foot forward in a flexed position, points the distal end of the barrel 3 downwards in a 6 o'clock position as shown in FIG. 4 and as he/she swings the arm forward and around in a clockwise direction, he/she steps his left foot forward and at approximately the 5 o'clock position, simultaneous with completing the step, the hips proximal to the hand performing the motion gives way for the hand as it performs the snapping motion. At the end of the snapping motion, the distal end of the barrel points approximately at the 10 o'clock position with the palms facing up. The plunger 10 inside the training device 100, concurrent with the snapping motion, disengages from the magnet 9 and hits the distal end 11 of the barrel 3 or reinforcement 12 to impart a snapping sound coincident with the user feeling the impact on the hand and its muscle due to the snapping motion. This association of the snapping sound with the impact on the hand and muscle helps develop the motor memory for the particular motion being trained on. The position of the clock relative to the person in all these illustration is shown in FIG. 4. For a clockwise motion, the arm swings forward and around. For counterclockwise, the arm swings backwards and around.

The users and players are familiar with the different types of throw, hits or swings for which the training device can be used. If one is training on a softball's 'change', the only difference between this type of throw and the fastball is that at the snapping motion, the wrist moves forward with palms facing down and the distal end of the barrel 3 ends up at approximately the 9 o'clock position instead of 10 o'clock. The same is true for the screw ball except that the snapping motion is done with the hand turning to the right, palms down, with the barrel 3 stopping at approximately the 7 o'clock position. For a rise ball, during the snapping motion, the hands turn to the left and slightly up with the distal end of the barrel 3 stopping approximately the 10 o'clock position. The drop ball is similar but here, the snapping motion is done when the hand reaches the 7 o'clock position instead of the 5 o'clock position with the distal end of the barrel 3 pointing to the 12 o'clock position at the end of the motion. For a curve ball, the snapping motion starts at the 4 o'clock position with the hand coming from the side, horizontally wrapping around the front and ending below the belt, palms facing up with the distal end of the barrel pointing approximately at the 9 o'clock position.

For a baseball throw, the hands moves upwards and around counterclockwise instead of clockwise and the snapping motion starts at approximately the 1 o'clock position with the wrist moving forward, palms going forward and under simulating a pitch and ending with the distal end of the barrel pointing at approximately the 11 o'clock position. For the other sports like tennis and racquetball, the handle 1 of the training device is held the same way as one would do in making a swing or a stroke with a racquet.

The above illustrates the use of the device for some of the many snapping motions involved or associated with a particular sports. The training device can also be used in performing short snappy motions in any directions, not mimicking any particular throw, hit or swing, but to simply strengthen the wrist and forearm.

While the embodiment of the present invention has been described, it should be understood that various changes, modifications and adaptations may be made therein without departing from the spirit of the invention and the scope of the appended claims. Those skilled in the art will recognize that other and further variations of the features presented herein are possible. The scope of the present invention should be determined by the teachings disclosed herein, the appended claims and their legal equivalents.

I claim:

1. A training device for developing a correct hand motion or strengthening the wrist and forearm or both, comprising: a handle, wherein the handle is hollow and has a protruding lip; a barrel directly extending perpendicularly from the handle; a stationary magnet vertically positioned at a proximal end of the barrel close to the handle; a plunger made of a magnet material releasable from the magnet, the plunger producing a snapping sound when the plunger hits a wall on a distal end of the barrel when dislodged from the magnet; means for interconnecting the handle with the barrel; and, means for holding the magnet stationary.

2. The training device of claim 1 further comprising a casing enveloping the barrel to keep the barrel, the magnet and the plunger in place.

3. The training device of claim 1 wherein the device is shaped to ergonometrically accommodate the hands of a user.

4. The training device of claim 1 wherein the device is portable.

5. The training device of claim 1 wherein the device except the magnet and plunger is made of plastic, wood, nonmagnetic metal or combinations of these.

6. The training device of claim 1 wherein the barrel and the handle are cylindrical in shape.

7. The training device of claim 1 further comprising a reinforcement to protect the surfaces of the handle, magnet, casing or barrel from damage due to the repeated impact or beating of the plunger.

8. The training device of claim 7 wherein the reinforcement is made of a rigid, non-flexible, nonmalleable metal that does not impede the attraction of the magnet to the plunger.

9. The training device of claim 1 wherein the magnet has sufficient force to keep the plunger attached but not strong enough to prevent the plunger from disengaging or dislodging from the magnet when a user snaps the plunger away from the magnet with a desired hand motion.

10. The training device of claim 1 wherein the distal end of the barrel is closed or open.

11. The training device of claim 1 wherein the plunger is free to move from one end of the barrel to the other after dislodge.

12. The training device of claim 1 wherein the plunger is cylindrical in shape.

13. The training device of claim 1 wherein the length of the training device enables the plunger to produce a sound as the plunger hits the distal end of the barrel at the same time as the impact of a snapping motion is felt on the hand and muscle of the user.

14. The training device of claim 1 wherein the barrel presses on the magnet or a reinforcement against the handle or a casing.

15. A method of using an enclosed training device having a hollow handle with a protruding lip, a barrel directly extending perpendicularly from the handle, a magnet vertically positioned at a proximal end of the barrel close to the handle and a plunger releasable from the magnet by a snapping hand motion, comprising: assuming a position as one would take for a particular motion; holding the training device; doing a correct hand motion for the particular motion; and, snapping the device thereby releasing the plunger from the magnet.

16. The method of claim 15 further comprising doing the correct motion of the feet.

17. The method of claim 15 wherein the device is held with the barrel between the index and the middle finger.

18. A training device for developing a correct hand motion or strengthening the wrist and forearm or both, comprising: a handle; a barrel directly extending perpendicularly from the handle; a stationary magnet vertically positioned at a proximal end of the barrel close to the handle; a plunger made of a magnetic material releasable from the magnet, the plunger producing a snapping sound when the plunger hits a wall on a distal end of the barrel when dislodged from the magnet; a casing enveloping the barrel to keep the barrel, the magnet and the plunger in place; means for interconnecting the handle with the barrel; and, means for holding the magnet stationary.

19. The training device of claim 18 wherein the handle is solid or hollow.

20. The training device of claim 18 wherein the hollow handle has a protruding lip.

* * * * *